US009671159B2

(12) United States Patent
Diederichs et al.

(10) Patent No.: US 9,671,159 B2
(45) Date of Patent: Jun. 6, 2017

(54) LIQUEFIER WITH PRESSURE-CONTROLLED LIQUEFACTION CHAMBER

(75) Inventors: Jost Diederichs, San Diego, CA (US); Ronald Sager, San Diego, CA (US)

(73) Assignee: QUANTUM DESIGN INTERNATIONAL, INC., San Diego, CA (US)

( * ) Notice: Subject to any disclaimer, the term of this patent is extended or adjusted under 35 U.S.C. 154(b) by 1193 days.

(21) Appl. No.: 13/550,297

(22) Filed: Jul. 16, 2012

(65) Prior Publication Data

US 2013/0014517 A1 Jan. 17, 2013

Related U.S. Application Data

(60) Provisional application No. 61/507,595, filed on Jul. 14, 2011.

(51) Int. Cl.
*F25J 1/00* (2006.01)
*F25B 9/00* (2006.01)
(Continued)

(52) U.S. Cl.
CPC ..... *F25J 1/0007* (2013.01); *F17C 3/085* (2013.01); *F17C 13/006* (2013.01);
(Continued)

(58) Field of Classification Search
CPC ..... F17C 3/085; F17C 13/006–13/007; F17C 13/04; F17C 2205/0391
See application file for complete search history.

(56) References Cited

U.S. PATENT DOCUMENTS 6,212,904 B1 4/2001 Arkharov
7,395,671 B2 * 7/2008 Miki ..... F17C 1/00 62/51.1
(Continued)

FOREIGN PATENT DOCUMENTS

JP 2003515086 T 4/2003
JP 2004-211935 7/2004
(Continued)

OTHER PUBLICATIONS

Small Scale 4He liquefaction using a two-stage 4K pulse tube cooler. G. Thummes et al. Cryogenics 38 (1998) 337-342. Published Mar. 1998.*
(Continued)

*Primary Examiner* — John F Pettitt
*Assistant Examiner* — Tareq Alosh
(74) *Attorney, Agent, or Firm* — Stetina Brunda Garred and Brucker; Mark B. Garred

(57) ABSTRACT

A liquefier includes a Dewar having a storage portion and a neck portion extending therefrom. A hermetically isolated liquefaction chamber is disposed within the neck of the Dewar. One or more control components including a temperature and pressure sensor are coupled to a CPU and disposed within the liquefaction chamber for dynamic control of liquefaction conditions. A gas flow control is coupled to the CPU for regulating an input gas flow into the liquefaction chamber. A volume surrounding the liquefaction chamber may be adapted to provide a counter-flow heat exchange. These and other features provide improved liquefaction efficiency among other benefits.

18 Claims, 10 Drawing Sheets

(51) Int. Cl.

| | |
|---|---|
| ***F17C 3/08*** | (2006.01) |
| ***F17C 13/00*** | (2006.01) |
| ***F17C 13/04*** | (2006.01) |
| ***F25D 19/00*** | (2006.01) |
| ***F25J 1/02*** | (2006.01) |

(52) U.S. Cl.

CPC ..... *F17C 13/007* (2013.01); *F17C 13/04* (2013.01); *F25D 19/00* (2013.01); *F25J 1/0225* (2013.01); *F25J 1/0236* (2013.01); *F25J 1/0244* (2013.01); *F25J 1/0276* (2013.01); *F25J 1/0294* (2013.01); *F17C 2205/0391* (2013.01); *F25B 2400/17* (2013.01); *F25J 2230/24* (2013.01); *F25J 2230/30* (2013.01); *F25J 2270/908* (2013.01); *F25J 2270/912* (2013.01)

(56) References Cited

U.S. PATENT DOCUMENTS

2006/0130493 A1* 6/2006 Strobel ..... F25D 19/006 62/51.1
2006/0260358 A1 11/2006 Kun
2009/0019886 A1* 1/2009 Willen ..... F25J 1/0208 62/606
2009/0049863 A1 2/2009 Wang
2010/0199690 A1* 8/2010 Husband ..... F17C 13/04 62/51.1
2010/0298148 A1 11/2010 Schlenga
2011/0271693 A1* 11/2011 Jiang ..... F25D 19/006 62/47.1

FOREIGN PATENT DOCUMENTS

JP 2010048452 8/2008
WO WO 2011139989 A2 * 11/2011 ..... F25J 1/0007

OTHER PUBLICATIONS

Chinese Office Action and English Translation thereof for Chinese Patent Application No. 201280040745X. Issued Mar. 31, 2015.
Extended European Search Report for PCT/US2012/046966 (6 pages). Issued Feb. 2, 2015.
Japanese Office Action for JP2014-520412 mailed on Nov. 4, 2015.
Japanese Patent Office. "Decision of Refusal," 4 pages. Mailed on Jul. 6, 2016 in relation to JP Application No. 2014-520412.

* cited by examiner

LIQUEFIER WITH PRESSURE-CONTROLLED LIQUEFACTION CHAMBER

CROSS-REFERENCE TO RELATED APPLICATIONS

This application claims priority to U.S. Provisional Ser. No. 61/507,595, filed Jul. 14, 2011; which is hereby incorporated by reference.

BACKGROUND OF THE INVENTION

Field of the invention

This invention relates to gas liquefaction systems, or "liquefiers"; and more particularly to a liquefier having an isolated liquefaction chamber adapted for dynamic pressure-control for achieving improved liquefaction efficiency.

Related Art

Gas liquefaction systems, also referred to as "liquefiers", are well documented in the art and generally comprise a vacuum insulated container known as a Dewar, the Dewar being adapted to receive at least a portion of a cryocooler for liquefying gas, and further comprising a storage portion for storing an amount of liquefied gas therein.

FIG. 1 illustrates a liquefier comprising a Dewar 200 and a cryocooler 100 extending within a neck portion 206 of the Dewar. Within these systems, such a Dewar generally comprises an outer shell 202, an inner shell 201, and volume 203 therebetween being substantially evacuated of air to form a thermally insulated container. Optionally, a thermal shield 204 (shown in dashed lines), such as a foil or similar material, may be further disposed between the inner and outer shells of the Dewar. The Dewar further comprises a storage body portion 205 and the neck portion 206 extending therefrom. The Dewar is adapted to store a volume of liquefied cryogen within the storage body portion. A helium gas source 310 generally feeds an input gas line 211 for supply of the gas to be liquefied. A compressor 110 operates a first stage regenerator 101*a* for cooling a first stage 101*b* of the cryocooler, and up to several additional regenerators and cooling stages depending on the cryocooler design. The cryocooler 100 is illustrated as having three cooling stages comprising in addition to the first stage regenerator and first stage, a second stage regenerator 102*a* for cooling a second stage 102*b*, and a third stage regenerator 103*a* for cooling a third stage 103*b*.

It is presently common for a cryocooler to comprise two or more cooling stages extending along a length of the cryocooler, such that a first stage thereof is adapted to pre-cool the gas and a subsequent stage is adapted to further cool the gas to a temperature sufficient for liquefaction. Moreover, each successive cooling stage typically comprises less surface area than the preceding stage, resulting in a cooling gradient along the several cryocooler stages.

Cryocoolers for use in such liquefiers and reliquefiers generally include a Gifford-McMahon (GM) type refrigerator or a pulse tube refrigerator; however these liquefiers may further include any type of refrigeration device for the purpose of cooling gases and condensing gas into a liquid phase. These liquefied gases are typically referred to as cryogenic liquids or cryogens.

Also documented in the art are "reliquefiers", which generally comprise a liquefier that is adapted to circulate and re-liquefy gas within a closed or semi-closed system.

FIG. 2 illustrates such a reliquefier, which is substantially similar in design to the liquefier of FIG. 1. The reliquefier of FIG. 2 further comprises equipment 320 coupled in fluid communication with the Dewar for receiving an amount of liquid cryogen. Subsequent to using the liquid cryogen, evaporated gas is collected from the equipment and recycled back into the liquefier using a recirculator 315 such as a pump or similar device. It should be noted that the "equipment 320" may include one or more instruments, such as medical or scientific analytical instruments, among others, and is not limited to a single instrument of any design. Additionally, it should be noted that there exists a myriad of design variations which essentially recirculate collected gas back through a liquefier to form a closed or semi-closed system.

These liquefiers and reliquefiers, however, are limited with respect to liquefaction efficiency, or the amount of liquefied cryogen that can be generated using a given cryocooler over a period of time. There is a continued need for liquefiers having improved liquefaction efficiency.

Of importance to this invention are the thermodynamic properties associated with cryogen gases. These properties are generally illustrated through a phase diagram, such as illustrated in FIG. 3. In particular, the thermodynamic properties of helium gas are of great interest since liquefied helium is presently in high demand within a multitude of industries.

Now turning to FIG. 3, a phase diagram depicts a liquefaction curve for helium gas for various pressures (bar) and temperatures (Kelvin). The hexagonal close-packed (hcp) and body centered cubic (bcc) phases of the solid are shown for completeness. The liquefaction curve comprises a number of points at which helium gas transitions to liquid phase, the points collectively defining the liquefaction curve. A first liquefaction point (b) indicates a transition from gas-phase helium to a liquid-phase at a pressure of about 1 bar (near atmospheric pressure) which requires a temperature of about 4.22 K; this is known as the "boiling point" for helium-4, and hence point (b). A second liquefaction point (c) indicates the liquefaction of helium gas at a slightly increased pressure of about 2.27 bar which requires a temperature of about 5.20 K; this is known as the "critical point" for helium-4. In view of the liquefaction curve, it becomes recognizable that if a slightly higher pressure can be provided within the liquefaction chamber of the liquefier, liquefaction of helium gas can be achieved at slightly higher temperatures. Moreover, at these higher temperatures, most cryocoolers will be capable of increased cooling power. Thus, to take advantage of the higher cooling power of the cryocooler, one might develop a liquefier capable of liquefaction at pressures above 1 bar, and more preferably between 1 bar and 2.27 bar.

The advantages of liquefying a gas at pressures above 1.0 bar have been further described in WIPO/PCT Publication No. PCT/US2011/034842, by Rillo et al., filed May 2, 2011, and titled "GAS LIQUEFACTION SYSTEM AND METHOD", the contents of which are hereby incorporated by reference. The Rillo system, however, merely describes embodiments wherein the cryocooler is positioned within the neck of a large Dewar such that the entire storage portion of the Dewar must be held at the elevated liquefaction pressure. This creates several serious problems: (i) Holding large cryogenic containers at high pressures is dangerous and further requires that the Dewar meet rigid safety requirements, thereby increasing the cost associated with the Dewar; (ii) before extracting the liquid cryogen, the Dewar pressure must be lowered to about 1.0 bar which results in the loss of a substantial amount of cryogen; and (iii) when lowering the pressure in the Dewar and removing the liquid cryogen from the Dewar, the system cannot simultaneously continue the liquefaction process at the optimum liquefaction pressure. To date, no instrument for liquefaction of gas has yet been developed that allows a gas to be liquefied at elevated pressures, stored at or near ambient pressures and further allows the user to extract the liquid cryogen from the Dewar while simultaneously continuing to liquefy gas at the optimal pressure. Such a system would also solve the problem of storing pressurized liquids and gasses at high pressures in large volume containers while realizing the benefits of pressurized liquefaction; i.e. increased efficiency. With increased efficiency, a smaller liquefier would be capable of replacing a larger liquefier while providing a similar liquefaction rate. Additionally, power would be conserved with the more efficient model.

SUMMARY OF THE INVENTION

The improved gas liquefaction system disclosed herein provides an apparatus and method for liquefying gases at pressures above 1.0 bar such that the system is adapted to: (i) take advantage of the higher cooling power of the cryocooler at higher temperatures to liquefy the gas more efficiently; (ii) eliminate the problem of storing a cryogenic liquid at high pressures; (iii) eliminate the need to lower the pressure in the storage portion of the Dewar to ambient pressure before removing the liquid cryogen; (iv) eliminate the loss of cryogen associated with lowering the pressure in the storage portion of the Dewar to ambient pressure; and (v) allow the liquefaction process to proceed simultaneously while the user is removing liquid cryogen from the storage portion of the Dewar. In particular the system is adapted to liquefy helium gas at an elevated pressure (and temperature) near the critical point of liquid helium for achieving improved liquefaction efficiency of helium. For helium, the pressure at the critical point is about 2.2 bar.

The liquefaction system, or liquefier, described herein comprises a pressure-controlled liquefaction chamber. A liquefaction region within the chamber is hermetically sealed and segregated from a storage portion of the Dewar. The liquefaction region is adapted to liquefy a cryogen gas at conditions near the critical point for the particular gas. The pressure-controlled liquefaction chamber further comprises a fluid collection reservoir which is in fluid communication with the storage portion of the Dewar through a conduit extending therebetween.

In various embodiments, the liquefier is adapted to actively monitor and dynamically regulate pressure within the liquefaction chamber for providing efficient liquefaction of gas. For example, a pressure sensor and/or a thermometer may be coupled to a CPU for measuring at least one of pressure and temperature within the liquefaction region of the liquefier. In this regard, the system is adapted to monitor liquefaction conditions such as pressure and temperature within the liquefaction chamber, and can further regulate the liquefaction of gas therein by increasing pressure within the liquefaction chamber (inserting high-pressure gas), decreasing pressure (exhausting gas), switching on/off the cryocooler, or other functions. Thus, the liquefier can be dynamically controlled for optimizing liquefaction conditions and thereby controlling the efficiency of the liquefier.

In certain embodiments, a heat exchange region is formed between an inner-neck surface of the Dewar and an outer wall surface of the liquefaction chamber. The heat exchange region provides counter-flow heat exchange as cold gas escaping from the storage portion of the Dewar circulates about the heat exchange region and cools the outer chamber surface.

In certain embodiments, the liquefaction system utilizes a series of control components such as thermometers, pressure sensors, and other devices to maintain the liquefaction conditions within the pressure-controlled liquefaction chamber at or near the critical point for the select gas; for example at or near 2.2 bar and 5.2 K for helium. The control components are connected to a CPU for dynamic computerized control.

Other features and benefits will be further recognized upon a review of the detailed description of the preferred embodiments as set forth below.

DETAILED DESCRIPTION OF THE PREFERRED EMBODIMENTS

Figure 1:
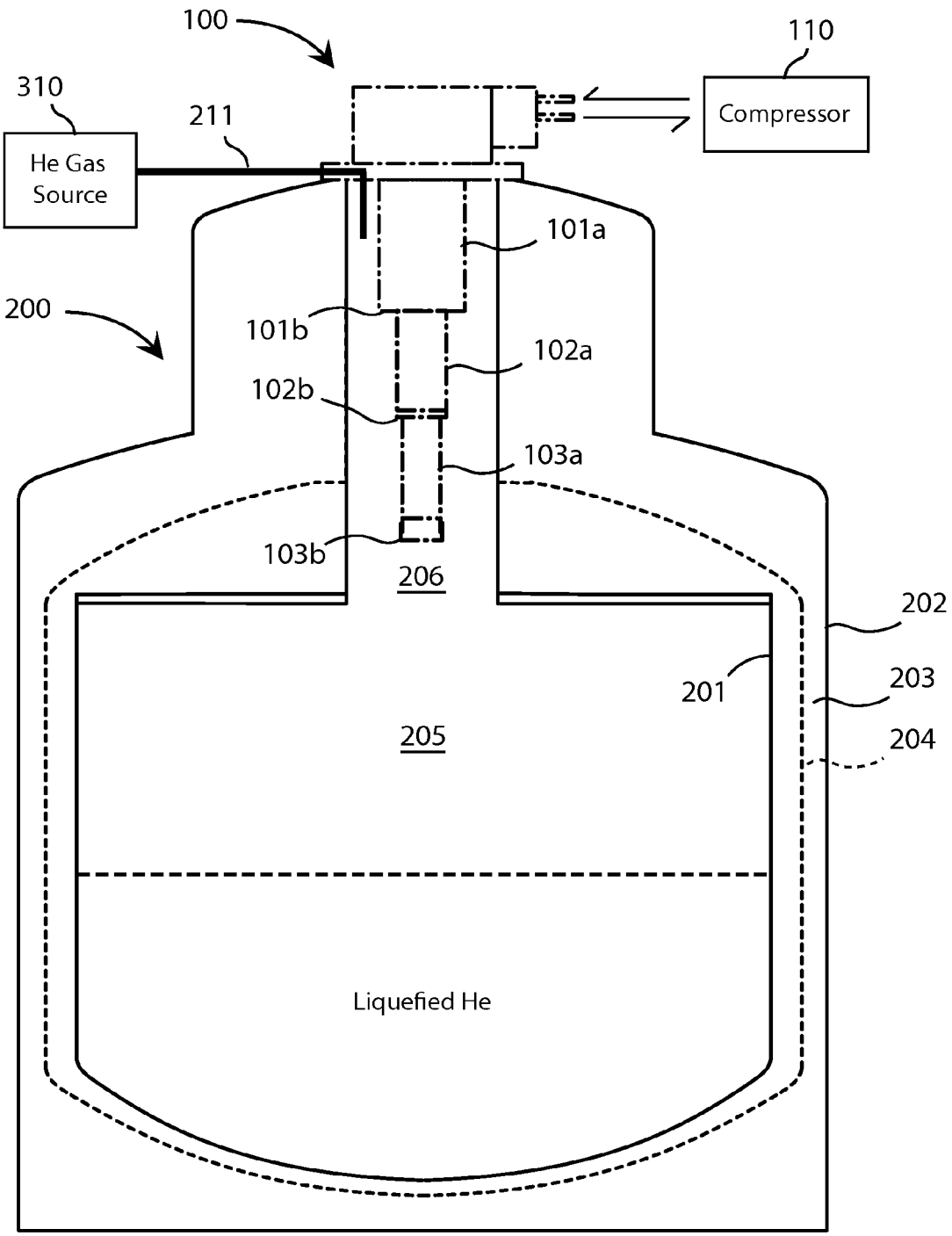
FIG. 1 (Prior Art)
FIG. 1 is a schematic illustrating the general components of a liquefier in accordance with the prior art.
Figure 2:
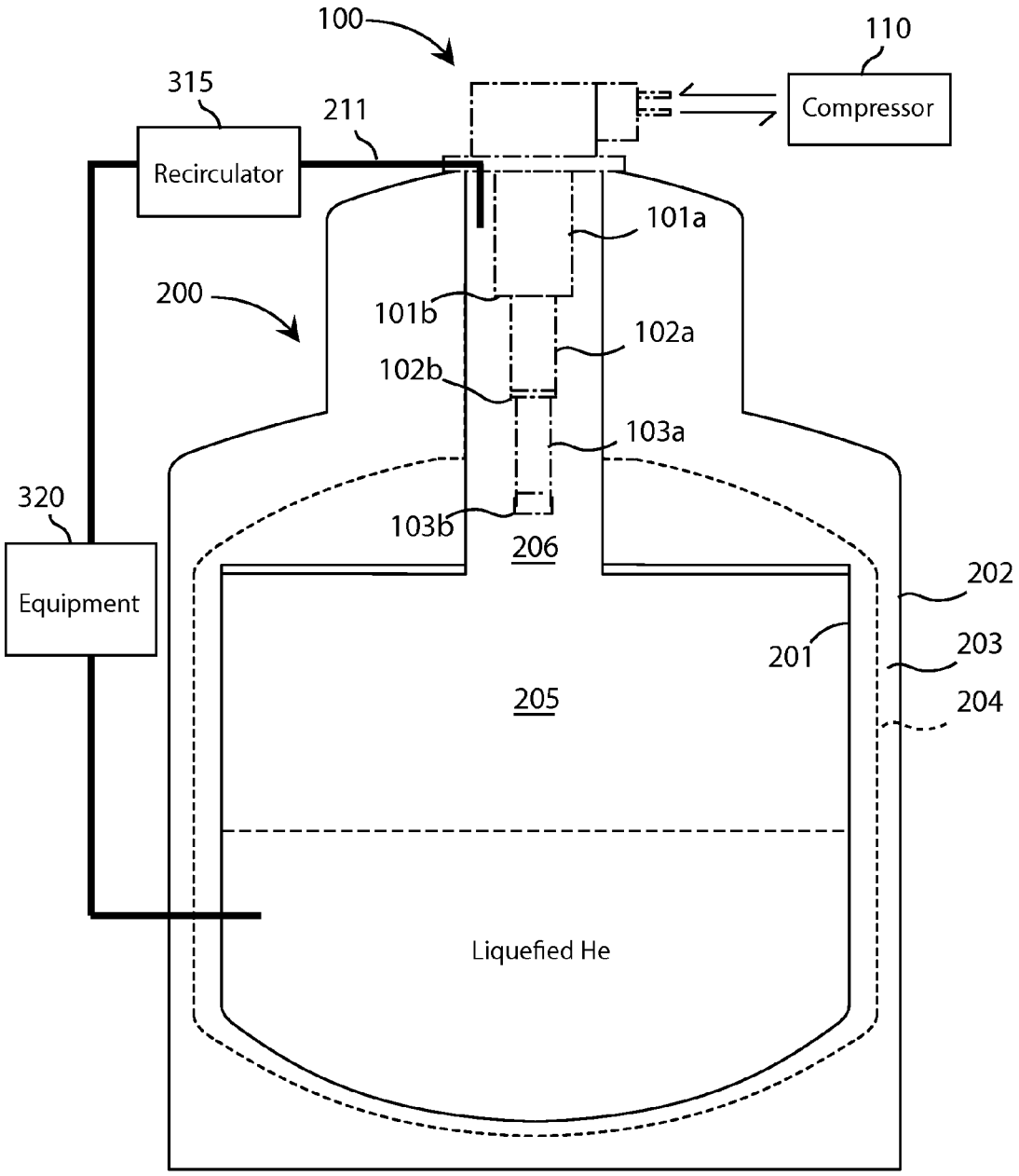
FIG. 2 (Prior Art)
FIG. 2 is a schematic illustrating the general components of a reliquefier in accordance with the prior art.
Figure 3:
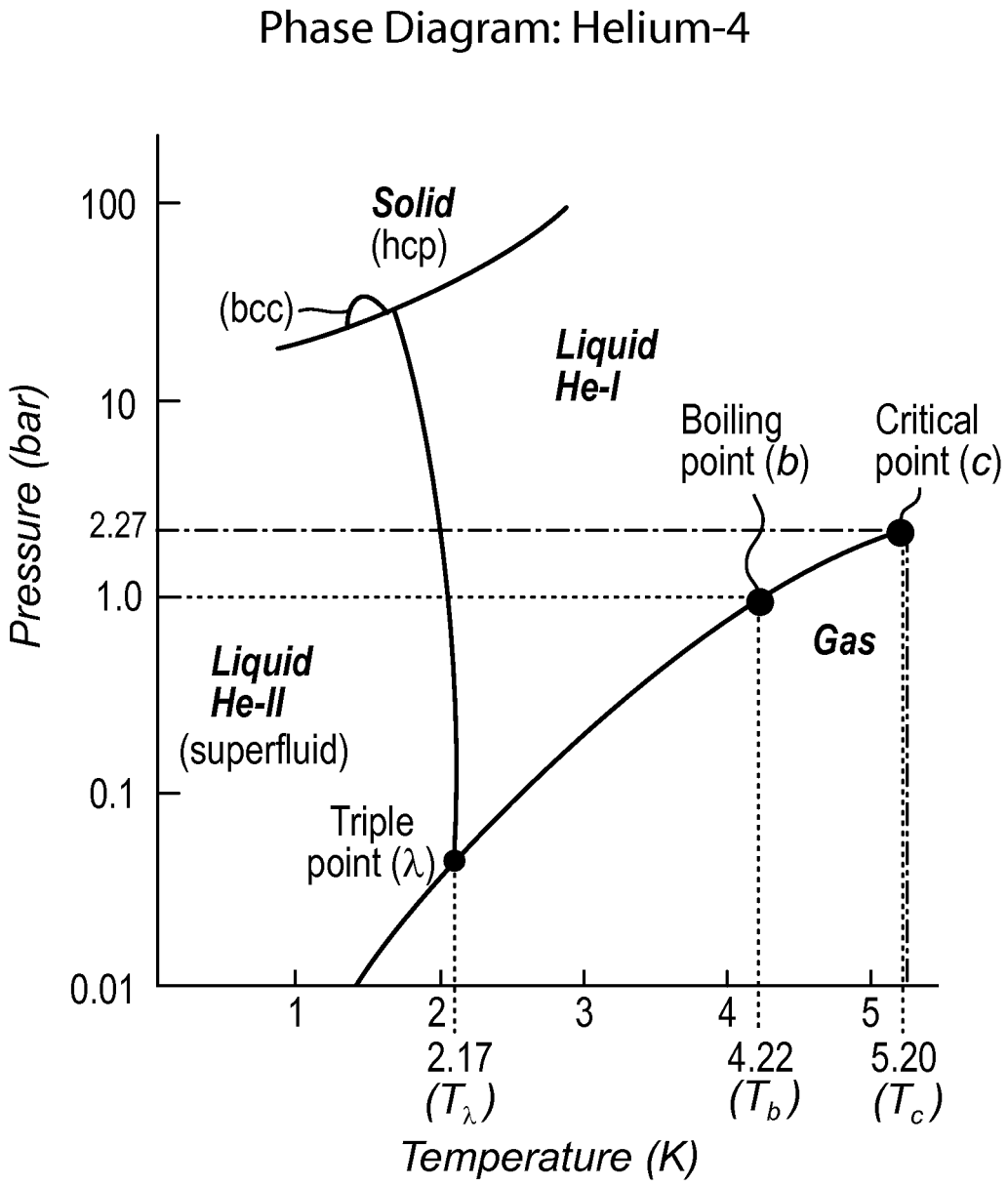
FIG. 3 (Prior Art)
FIG. 3 depicts a phase diagram for helium-4, and more particularly a liquefaction curve extending between helium's boiling point and critical point and associated pressures and temperatures extending along the liquefaction curve.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

In a general embodiment, a liquefier comprises a storage portion and a liquefaction chamber that is sealed from the storage portion such that liquefaction of gas is performed within the liquefaction chamber under isolated conditions from the storage portion; i.e. elevated pressure. In this regard, the liquefaction region of the chamber is generally pressurized above atmospheric pressure during the process of gas liquefaction, whereas the storage portion maintains liquefied gas at atmospheric pressure such that the liquefied gas may be readily utilized without suspending the process of gas liquefaction. The liquefaction region is in fluid communication with the storage portion of the liquefier through at least one conduit extending from a fluid collection reservoir to the storage portion. Thus as liquid collects within the fluid reservoir of the liquefaction chamber it may be transferred to the storage portion through the conduit.

Figure 4:
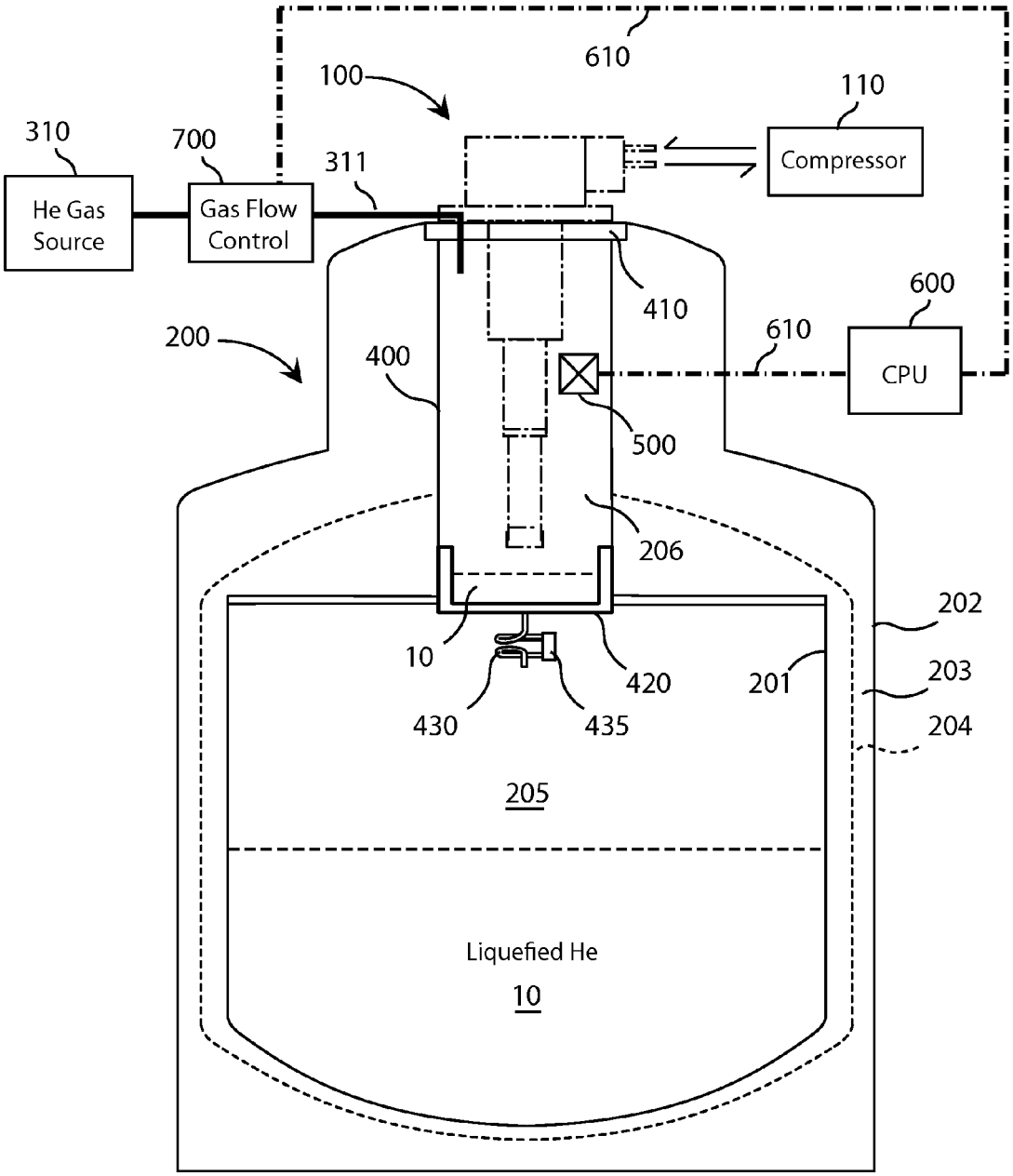
FIG. 4 illustrates a liquefier having a pressure-controlled liquefaction chamber being hermetically isolated from a storage portion of a surrounding Dewar container; a CPU is coupled to a gas flow control and one or more control components for dynamically controlling pressure within the liquefaction chamber.

FIG. 4 illustrates a liquefier in accordance with various embodiments. The liquefier comprises a Dewar 200 having a storage portion 205 and a neck portion 206 extending therefrom. The Dewar generally comprises an outer shell 202 and an inner shell 201 nested within the outer shell to form a volume 203 therebetween. The volume 203 between the outer shell and the inner shell is evacuated of air to provide thermal insulation. The vacuum region 203 of the Dewar may optionally contain a radiation shield or an additional shell 204 (shown with dashed lines). The liquefier may be adapted with two or more necks and sleeves, or other optional variations, however, for simplicity of describing the function of the system a single Dewar neck and will be shown in the drawings.

The liquefier is further characterized in that the neck portion 206 is further adapted to at least partially comprise a liquefaction chamber being hermetically isolated from the storage portion 205. The liquefaction chamber 400 comprises a tubular wall within the neck portion of the Dewar. The chamber may utilize a tubular portion of the Dewar neck to form the liquefaction chamber, or a concentrically-disposed tubular sleeve may be integrated within the Dewar neck to form the tubular wall. The inner-volume of the chamber is also referred to herein as the "liquefaction region" of the liquefier since gas is liquefied therein. A fluid collection reservoir 420 is disposed at a bottom end of the liquefaction chamber, wherein liquefied gas is gathered and at least temporarily stored prior to transfer from the liquefaction chamber to the storage portion of the liquefier. A conduit 430 connects the fluid collection reservoir to the storage portion 205 of the Dewar, wherein an amount of liquefied gas 10 is stored within the storage portion for use at or near ambient pressure.

A cryocooler 100 may comprise one or more cooling stages extending within the liquefaction region of the liquefier. The liquefaction chamber may be sealed with the cryocooler or any bracket or plate 410 attached to a head portion of the cryocooler such that the region within the chamber may be hermetically isolated for providing pressure-controlled liquefaction at elevated pressure. The cryocooler can be of any type, but generally may comprise a multistage GM or pulse tube type cryocooler. A compressor 110 is generally coupled the cryocooler in accordance with known embodiments.

One or more restriction elements 435, such as valves or heaters, can be further connected to the conduit 430 such that the flow of liquid cryogen from the fluid reservoir 420 to the storage portion 205 can be regulated. Optionally, a computer, or "CPU" 600, can be used to dynamically adjust the restriction element(s) for regulating the flow liquefied cryogen from the fluid reservoir to the storage portion.

The CPU 600 is generally connected to gas flow control 700 and one or more control components 500 via respective control cables 610. The control components 500 may comprise one or more of: temperature sensors, pressure sensors, fluid level sensors, various valves, or other components useful in regulating temperature and pressure within a closed-system. The CPU is adapted with software for utilizing the control components to monitor liquefaction conditions within the liquefaction chamber, and further adapted to adjust the valves associated with the gas flow control, exhaust valves for venting the chamber, or other components.

Gas within the liquefaction chamber is pressurized above 1.0 bar during liquefaction; and in the case of helium pressure is ideally is maintained near 2.2 bar during liquefaction. At this elevated pressure, the helium is liquefied with maximum cooling power being realized from the cryocooler and efficiency is significantly improved. The pressure within the liquefaction region is be regulated by CPU 600, which is coupled to gas flow control 700 through a control cable 610 as described above. Thus, a volume of input gas can be delivered at a pressure above one atmosphere into the sealed liquefaction chamber 400, thereby increasing pressure therein. As the gas condenses into liquid, additional gas is supplied to the system from an external gas source 310 via gas flow control 700 and the input gas line 311 extending from the gas flow control to the liquefaction chamber of the Dewar. Utilizing the gas flow control 700 and control components 500 including one or more temperature sensors, pressure sensors, and exhaust valves among others, the CPU can precisely control the pressure in the sealed liquefaction chamber to maintain the optimal liquefaction parameters at all times, thereby achieving the maximum possible liquefaction efficiency.

Figure 5:
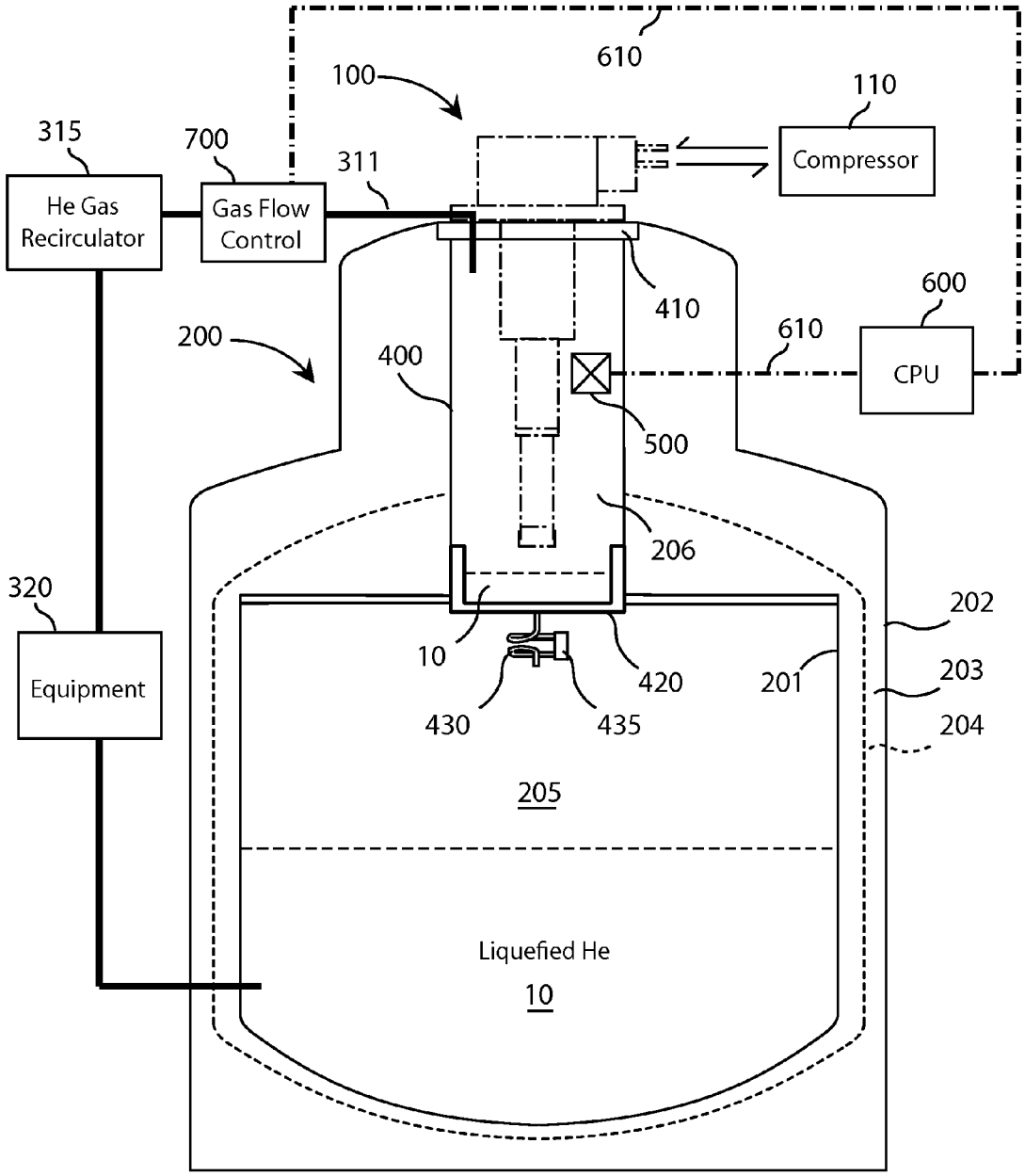
FIG. 5 illustrates a reliquefier having a similar design to the liquefier of FIG. 4.

FIG. 5 is a schematic of a reliquefier in accordance with an embodiment wherein the liquefier of FIG. 4 is coupled to one or more instruments collectively labeled "Equipment 320". The equipment 320 is coupled to a He gas recirculator 315 such as a pump or a network of components designed to collect evaporated gas from the equipment, compress the gas, and deliver the gas to the liquefaction chamber 400 through the gas flow control 700.

Figure 6:
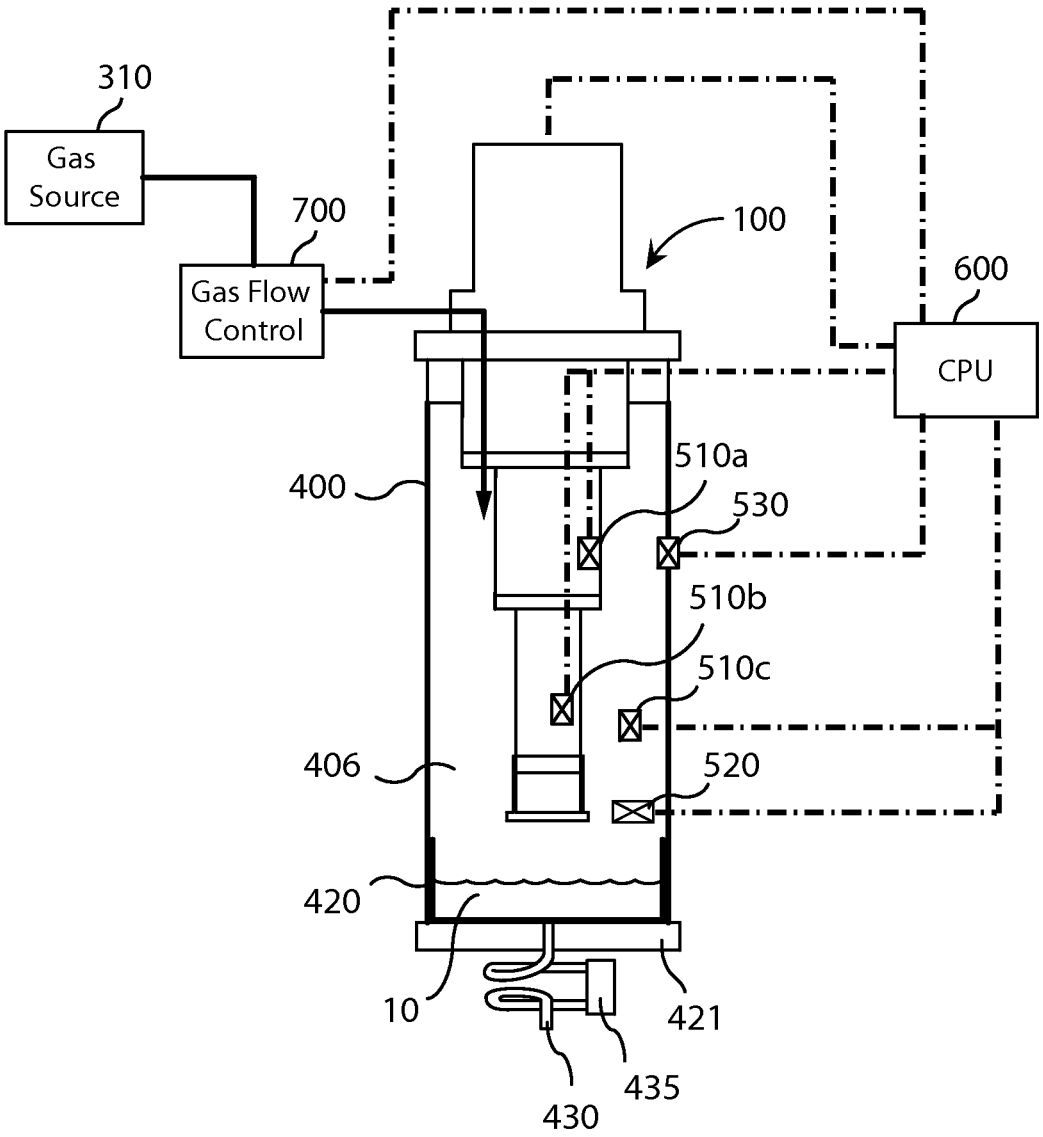
FIG. 6 illustrates a CPU being coupled to a cryocooler, a gas flow control, and number of control components such as pressure sensors, temperature sensors, and an exhaust valve; the CPU is adapted to dynamically control pressure within the liquefaction chamber.

FIG. 6 further illustrates the pressure-controlled liquefaction chamber of FIGS. 4-5. The chamber 400 comprises a chamber body having a volume 406 for liquefying gas. A cryocooler 100 is sealed at a top end of the chamber and one or multiple cooling stages thereof extend into the volume 406. A fluid reservoir 420 is coupled to a bottom plate 421 and sealed at a bottom end of the chamber 400. In this regard, the volume 406 extending between the top end and bottom end of the chamber is hermetically sealed and adapted to provide a closed-system liquefaction environment capable of being pressurized above 1.0 bar for liquefaction of gas at elevated pressures.

Gas for liquefaction within the chamber is provided by any gas source 310, and regulated at gas flow control 700. Gas within the chamber 400 is liquefied to form a liquid cryogen 10 which collects in the bottom portion of the chamber at the fluid collection reservoir 420. A conduit 430 extends from the fluid reservoir 420, through the bottom plate 421, into the storage portion of the Dewar. The conduit may further comprise one or more restriction elements 435, such as valves or heaters, to regulate a flow of liquid cryogen from the fluid reservoir 420 to the storage portion.

A CPU 600 is connected to temperature probes 510*a*, 510*b*, and 510*c* disposed within the liquefaction chamber 400. Temperature probes 510*a*; 510*b* are positioned on the cooling stages of the cryocooler for monitoring of a temperature of the various stages. Temperature probe 510*c* is positioned off of the cooling stages and within the liquefaction region of the chamber. In this regard, temperature probes can be positioned for monitoring temperature at various regions and components within the chamber. In addition to the temperature probes, CPU 600 is further connected to pressure sensor 520 disposed within the liquefaction chamber. Although one pressure sensor is illustrated, it should be understood that several pressure sensors may be implemented. With the temperature and pressure sensors, the CPU can monitor liquefaction conditions such as chamber pressure and chamber temperature in real time.

The CPU 600 is further connected to gas flow control 700. In this regard, pressure may be increased within the chamber 400 upon delivery of an amount of high-pressure gas. Given the known volume 406 of the liquefaction chamber and the chamber pressure determined at the pressure sensor 520, CPU 600 can be programmed to determine a volume of high pressure gas required for delivery into the chamber in order to achieve an optimum chamber pressure for efficient liquefaction of gas. As gas is liquefied and transferred to the storage portion, pressure within the chamber drops, requiring a dynamic monitoring of liquefaction conditions such that the input flow of gas through the gas flow control may be regulated to maintain optimum conditions.

If pressure within the chamber is too high, CPU 600 can vent an amount of gas within the chamber through exhaust valve 530. The vented gas will reduce the pressure in chamber 400, and may be collected for reuse such that precious helium may not be lost.

A fluid level sensor (not illustrated) may be implemented at the bottom end of the chamber for determining a volume of liquefied cryogen within the fluid collection reservoir 420. Fluid level sensors are well known and described in the art and thus are not described in detail here. Any fluid level sensor can be positioned adjacent to the fluid reservoir and coupled to the CPU for dynamic monitoring of the fluid level within the reservoir.

CPU 600 is further connected to the cryocooler 100 such that the cryocooler may be switched on/off as may be required.

Figure 7A:
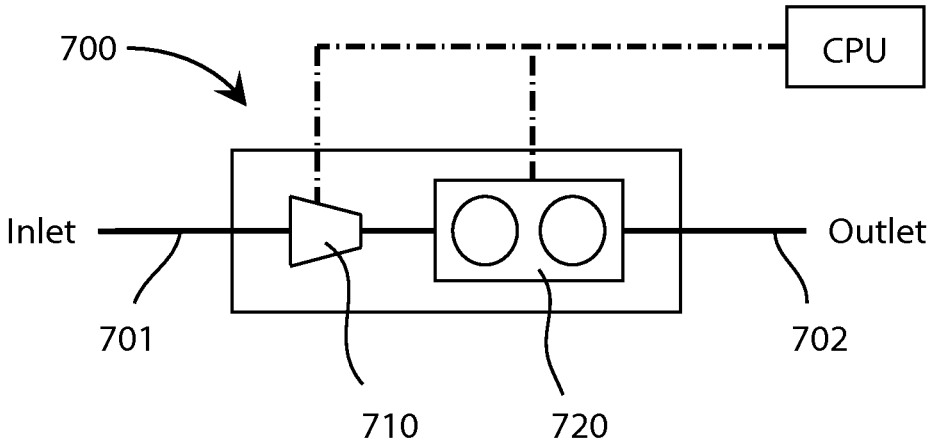
FIG. 7A illustrates a CPU being coupled to a gas flow control for dynamically controlling high-pressure gas entering the liquefaction chamber; the gas flow control comprises a pressure regulator and a mass flow controller.
Figure 7B:
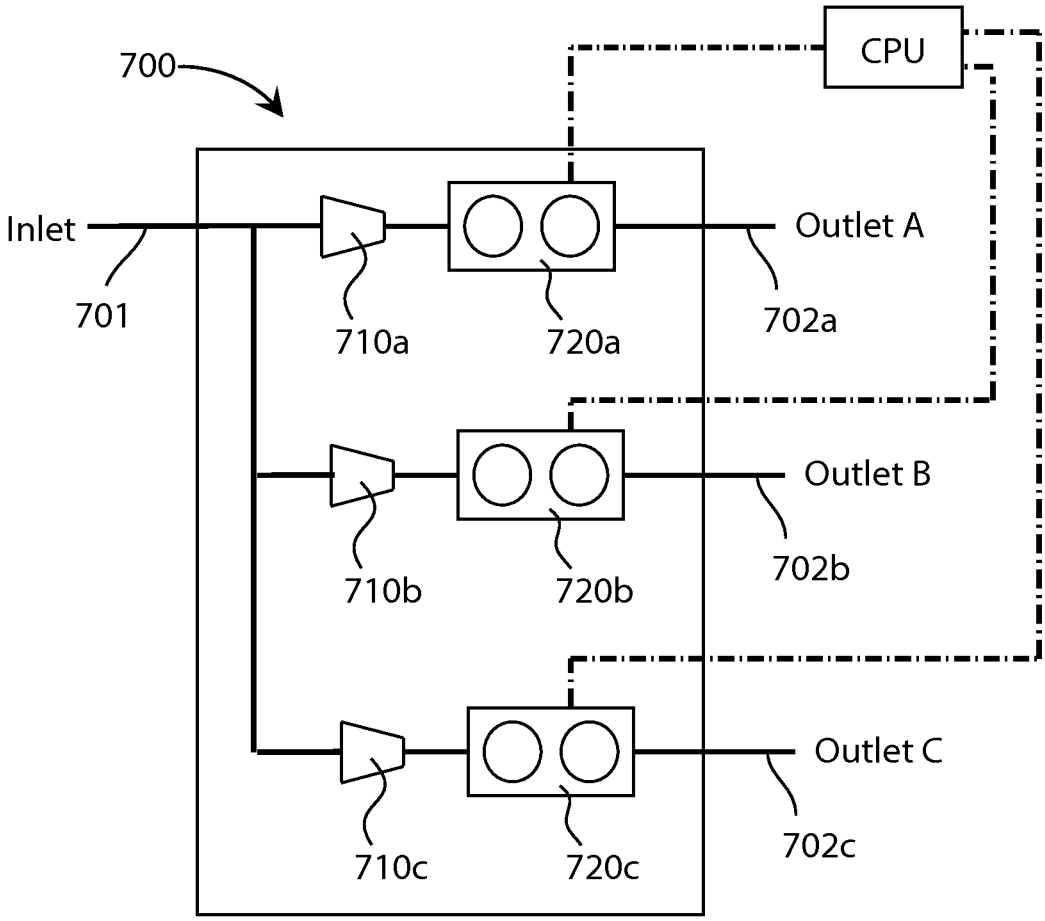
FIG. 7B illustrates a CPU being coupled to a gas flow control for dynamically controlling high-pressure gas entering the liquefaction chamber; the gas flow control comprises a plurality of pressure regulators being connected in series with corresponding mass flow controllers.

FIGS. 7A-7B further illustrate embodiments of the gas flow control 700.

In one embodiment as illustrated in FIG. 7A, gas flow control 700 comprises a pressure regulator 710 for regulating a pressure of gas to flow therefrom, and a mass flow controller 720. An inlet 701 is used to supply gas from a gas source, and an outlet 702 is used to deliver gas to the liquefaction chamber of a liquefier.

Pressure regulator 710 is illustrated as being a dynamic pressure regulator capable of computer control and coupled to the CPU such that pressure may be actively controlled through the regulator 710; however a static mechanical regulator, such as the type utilizing a valve and seat may be similarly incorporated.

The mass flow controller (MFC) 720 is designed and calibrated to control a specific type of fluid or gas at a particular range of flow rates; and in these example the MFC is designed for use with helium. The MFC can be given a setpoint from 0 to 100% of its full scale range but is typically operated in the 10 to 90% of full scale where the best accuracy is achieved. The device will then control the rate of flow to the given setpoint. The MFC can be either analog or digital. The MFC comprises an inlet port, an outlet port, a mass flow sensor and a proportional control valve. The MFC is fitted with a closed loop control system which is given an input signal by the CPU that it compares to the value from the mass flow sensor and adjusts the proportional valve accordingly to achieve the required flow. The flow rate is specified as a percentage of its calibrated full scale flow and is supplied to the MFC as a voltage signal. The Mass flow controller may require the supply gas to be within a specific pressure range, and thus it is coupled in series to a pressure regulator. For example, low pressure will starve the MFC of gas and it may fail to achieve its setpoint, whereas high pressure may cause erratic flow rates.

In another embodiment, FIG. 7B illustrates a gas flow control 700 comprising an inlet 701 for delivering gas from a gas supply, and multiple outlets 702*a*; 702*b*; and 702*c* each configured to deliver gas to the liquefier at a distinct pressure. In this regard, gas can be supplied from the gas flow control at various pressures for precision control of chamber pressure within the liquefaction chamber of the liquefier.

In order to accomplish the multiple pressures provided by outlets A-C, a number of regulators are adapted to step down the pressure from the supply gas. For example, regulator 710*a* may be set at a first high pressure; regulator 710*b* may be set at a second middle pressure less than the high pressure; and regulator 710*c* may be set at a low pressure less than the middle pressure; each of the low through high pressures will be above 1.0 bar. Each regulator 710(*a-c*) is independently coupled to a mass flow controller 720*a*; 720*b*; 720*c* and coupled to a corresponding outlet (A-C). A CPU is connected to each of the respective MFC's. In this regard, high-pressure gas can be delivered to the liquefaction chamber of the liquefier at a variety of pressures.

Figure 8:
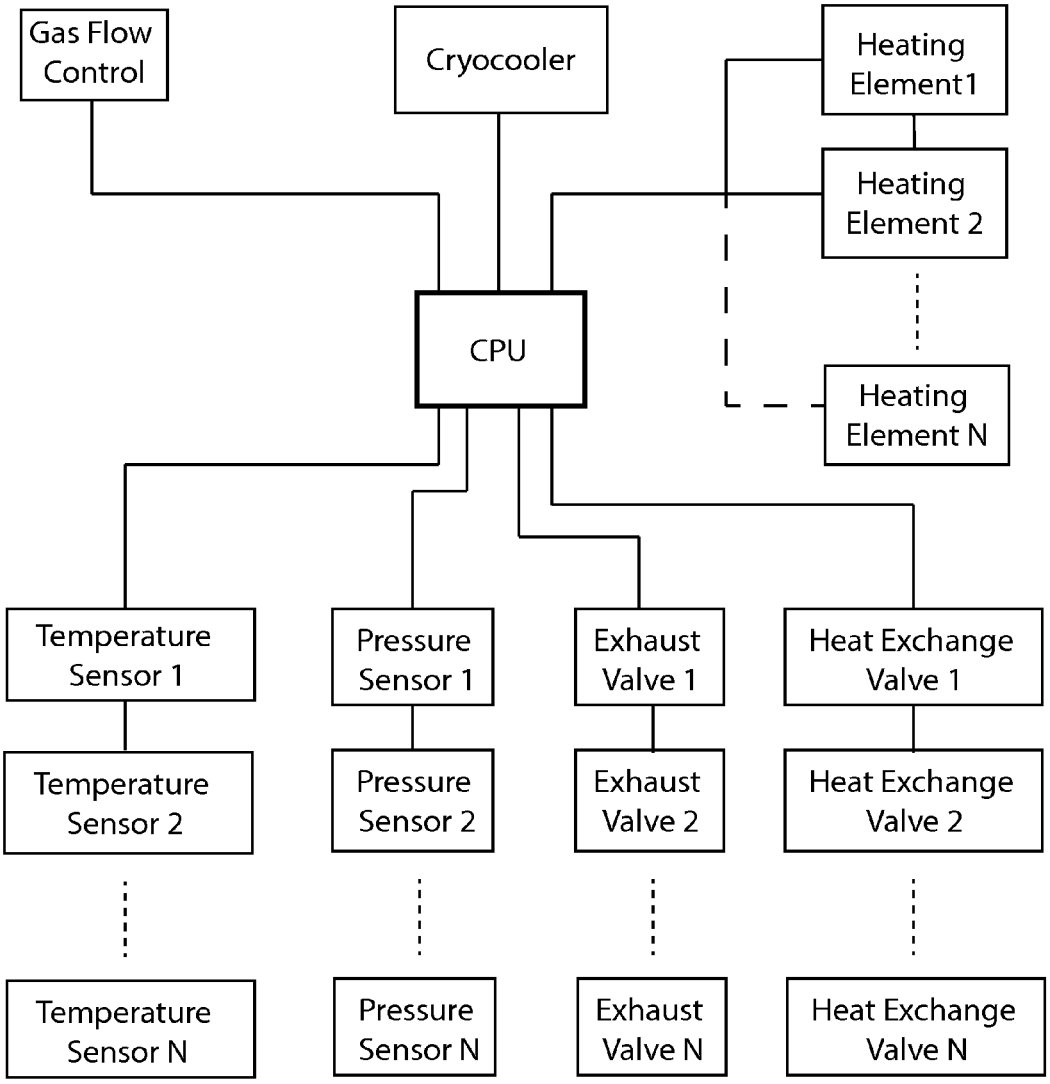
FIG. 8 illustrates A CPU being coupled to a gas flow control, a cryocooler, and a plurality of control components including heating elements, temperature sensors, pressure sensors, exhaust valves, and heat exchange valves.

FIG. 8 is a schematic of a CPU being connected to the gas flow control, a cryocooler, one or more heating elements, one or more temperature sensors, one or more pressures sensors, one or more exhaust valves, and one or more heat exchange valves (discussed below). Moreover, up to any number "N" of individual components can be connected to the CPU and oriented within the liquefier for providing data related to liquefaction conditions or actively controlling the liquefaction conditions within the chamber. In this regard, the CPU is the heart of the system and can be programmed to control various components within the liquefier for monitoring and dynamically regulating liquefaction conditions within the liquefier.

While the embodiment described FIGS. 4-7 above may be the simplest embodiment of the invention, it should be noted that various enhancements might be added to further improve the thermal efficiency of the system.

Figure 9:
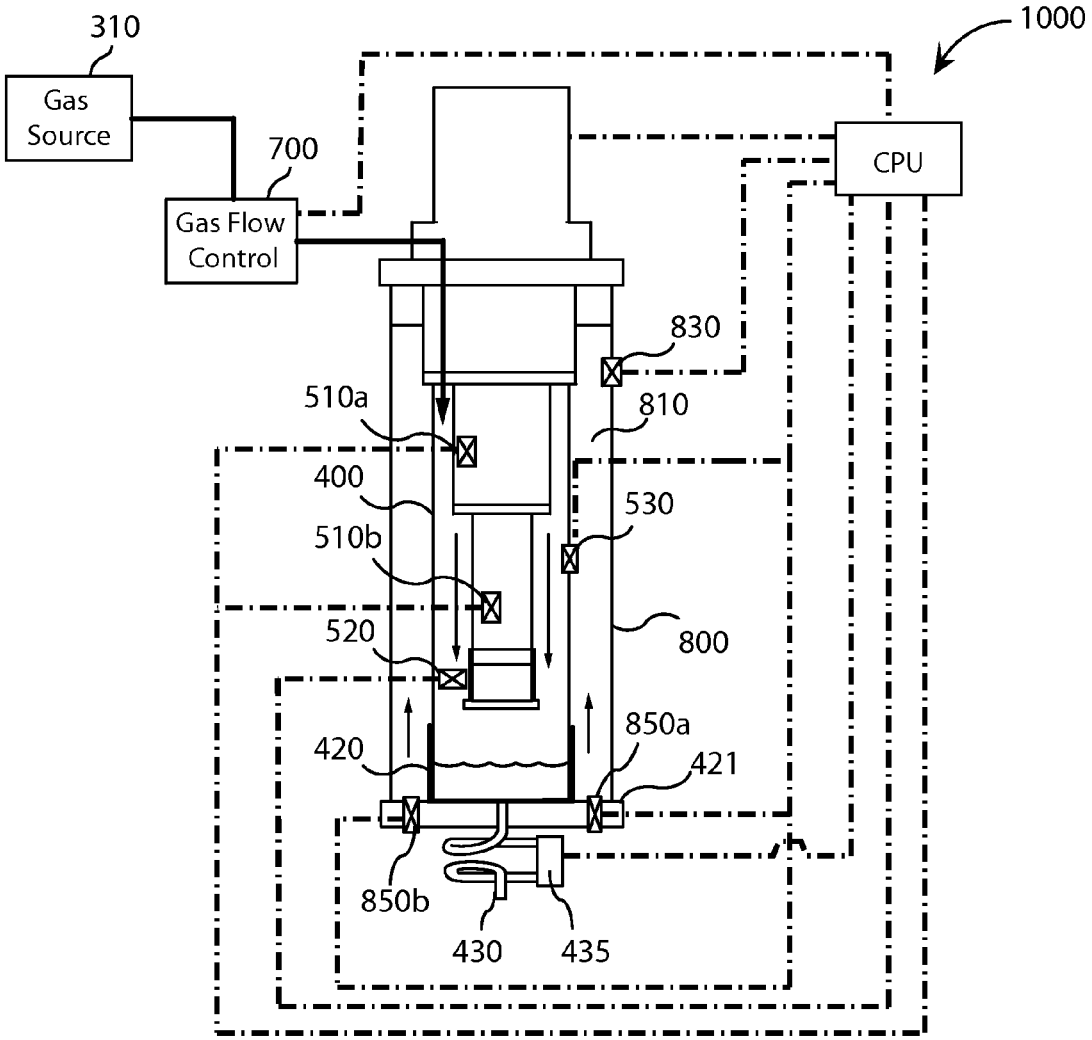
FIG. 9 illustrates a pressure-controlled liquefaction chamber in accordance with an embodiment, the liquefaction chamber further comprises a heat exchange region for providing counter-flow heat exchange with the chamber surface.

For example, in an embodiment 1000 illustrated in FIG. 9, the liquefaction chamber 400 is disposed within the neck portion 800 of the Dewar. Moreover, one or more exhaust valves 530 may be disposed along the wall of the liquefaction chamber and adapted to vent or release excessive cryogen gas for the purpose of reducing pressure within the liquefaction region. The vented gas can be directed into a heat-exchange region 810 formed between the Dewar neck 800 and the outer surface of chamber 400. In this regard, the one or more valves 530 may be connected to a CPU for dynamic regulation of pressure within the liquefaction region of the liquefier. By adjusting pressure within the liquefaction region, the liquefaction rate and liquefaction efficiency can be controlled.

FIG. 9 further illustrates a second use of the heat-exchange region for providing a secondary cooling effect. For example, cold gas from the storage portion of the liquefier may be circulated about the heat exchange region 810. Regulation of gas flowing in and out of the heat exchange region is achieved using one or more heat exchange valves 850*a*; 850*b*, as well as an exhaust valve 830 for venting gas from the heat exchange region 810. Heat exchange valves 850*a*; 850*b*, and exhaust valve 830 are further coupled to the CPU for dynamic control. In this regard, cold gas from the storage portion can be utilized to cool the chamber wall, such that input gas flowing into the liquefaction chamber may contact the chamber wall for providing a secondary source of cooling to the gas as it flows toward the cryocooler.

Similar to the pressure-controlled liquefaction chamber of FIG. 6, the chamber illustrated in FIG. 9 further comprises temperature sensors 510*a*; 510*b*, and pressure sensor 520 coupled to the CPU. The conduit 430 extends through bottom plate 421 into the storage portion, and is used to transfer liquefied cryogen from the fluid collection reservoir 420 to the storage portion of the Dewar. One or more restriction elements 435, such as valves or heaters, can be connected to the conduit 430, and further connected to the CPU, such that the flow of liquid cryogen from the fluid reservoir 420 to the storage portion can be dynamically regulated.

The CPU is coupled to the cryocooler for switching power to the cryocooler between on/off. Moreover, the CPU is further coupled to the gas flow control 700 for dynamically regulating an input gas flow into the liquefaction chamber as described above.

Figure 10:
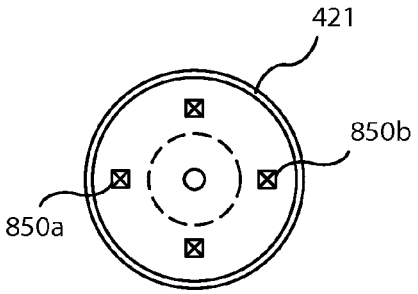
FIG. 10 illustrates an isolation plate having a number of heat exchange valves disposed thereon for use in the embodiment illustrated in FIG. 9.

FIG. 10 illustrates a top view of the bottom plate 421 provided for sealing a region between the storage portion and the heat exchange region according to one embodiment of the invention. The plate can be adapted with one or more heat exchange valves 850*a*; 850*b* for regulating gas flow between the storage portion and the heat exchange region. As described above, cold gas from an upper end of the storage portion, wherein the temperature is generally about 4.3 K for the embodiments utilizing helium, is permitted to flow into the heat exchange region using the one or more heat exchange valves. In this regard, gas flowing about the heat exchange region may contact the outer surface of the liquefaction chamber for providing counter-flow heat exchange about the sleeve surface. Moreover, an optional computer-controlled interface would enable dynamic control of heat exchange about the heat exchange region such that ideal liquefaction conditions are maintained about the liquefaction region, ideal storage conditions are maintained about the storage portion, and the combination of these conditions may be dynamically modulated.

For purposes of this invention, the valves 530; 830 used for venting gas from the liquefaction chamber and heat exchange region, respectively, are referred to herein as "exhaust valves"; and the valves 850*a*; 850*b* used to regulate flow between the storage portion and the heat exchange region are referred to herein as "heat exchange valves". Moreover, the one or more valves adapted to regulate a flow through the conduit between the collection reservoir and the storage portion are herein referred to as "restrictor valves", and the one or more valves adapted to regulate input gas flow from the gas flow control are referred to herein as "input valves". In this regard, each of the various valves may be individually differentiated with respect to their distinct functions.

In certain embodiments where a counter-flow heat exchange is not desired, the liquefaction sleeve can be thermally isolated by a vacuum insulated shell, and/or a radiation shield. In this embodiment, the liquefaction chamber may comprise an outer shell portion and an inner shell portion (not illustrated), wherein a volume disposed between the inner and outer shell portions is substantially evacuated of air to form a vacuum region therein for thermal isolation. Additionally, a heat shield can be disposed between, or adjacent to, one or both of the inner and outer shell portions.

In the various embodiments, gas within the liquefaction chamber is pressurized near the critical point of the gas; for example helium gas is maintained near 2.2 bar during liquefaction. At this elevated pressure, the helium or other gas is liquefied with maximum cooling power being realized from the cryocooler and efficiency is significantly improved. The pressure within the liquefaction chamber can be regulated with the one or more components as described above. For example, a volume of input gas can be delivered at a pressure above one atmosphere into the sealed liquefaction region, thereby increasing pressure therein. As the gas condenses into liquid, additional gas is supplied to the system from a gas source. The pressure of the input gas can be adjusted using a gas flow control.

In the event of high-pressure, for example above the critical pressure for the target gas, the one or more exhaust valves can be adapted to release gas into the heat exchange region, or other compartments as described above.

To prevent excessive accumulation of liquid within the fluid collection reservoir, one or more methods can be implemented. For example, a stinger (not illustrated) may extend from a bottom stage of the cryocooler such that contact with liquefied cryogen may rapidly decrease the temperature of the stinger. One or more thermometers may be further attached to the cryocooler, or the stinger, such that temperature can be monitored. The thermometers can be connected to the CPU for dynamic regulation of the conditions within the liquefier. In this regard, the system can shut down upon sensing a rapid decrease in temperature which would indicate excessive liquid within the collection reservoir. Alternatively, the conduit extending from the fluid reservoir to the storage portion may be adapted to increase flow rate upon indication of excessive liquid in within the collection reservoir. The flow rate through the conduit can be adjusted by tuning the a restrictor valve, or adjusting heat using a heater element attached to the conduit. Moreover, the input gas flow can be adjusted at the gas flow control for regulating pressure within the liquefaction chamber. Each of the valves, temperature sensors (thermometers), pressure sensors, or heater elements can be connected to a CPU programmed to monitor dynamically adjust liquefaction conditions for dynamic control of liquefaction process.

In certain embodiments, the fluid collection reservoir can be adapted to contain about 1.0 liters of liquid gas. In other embodiments, the fluid collection reservoir can be adapted to contain between 0.1 and 5 liters of liquid gas. Depending on user requirements, the fluid collection reservoir can be adapted to contain any amount of liquefied gas. Furthermore, the storage portion of the Dewar can be configured to contain any amount of liquefied gas. In certain embodiments, the storage portion is adapted to contain up to 1000 liters of liquid gas.

Figure 11:
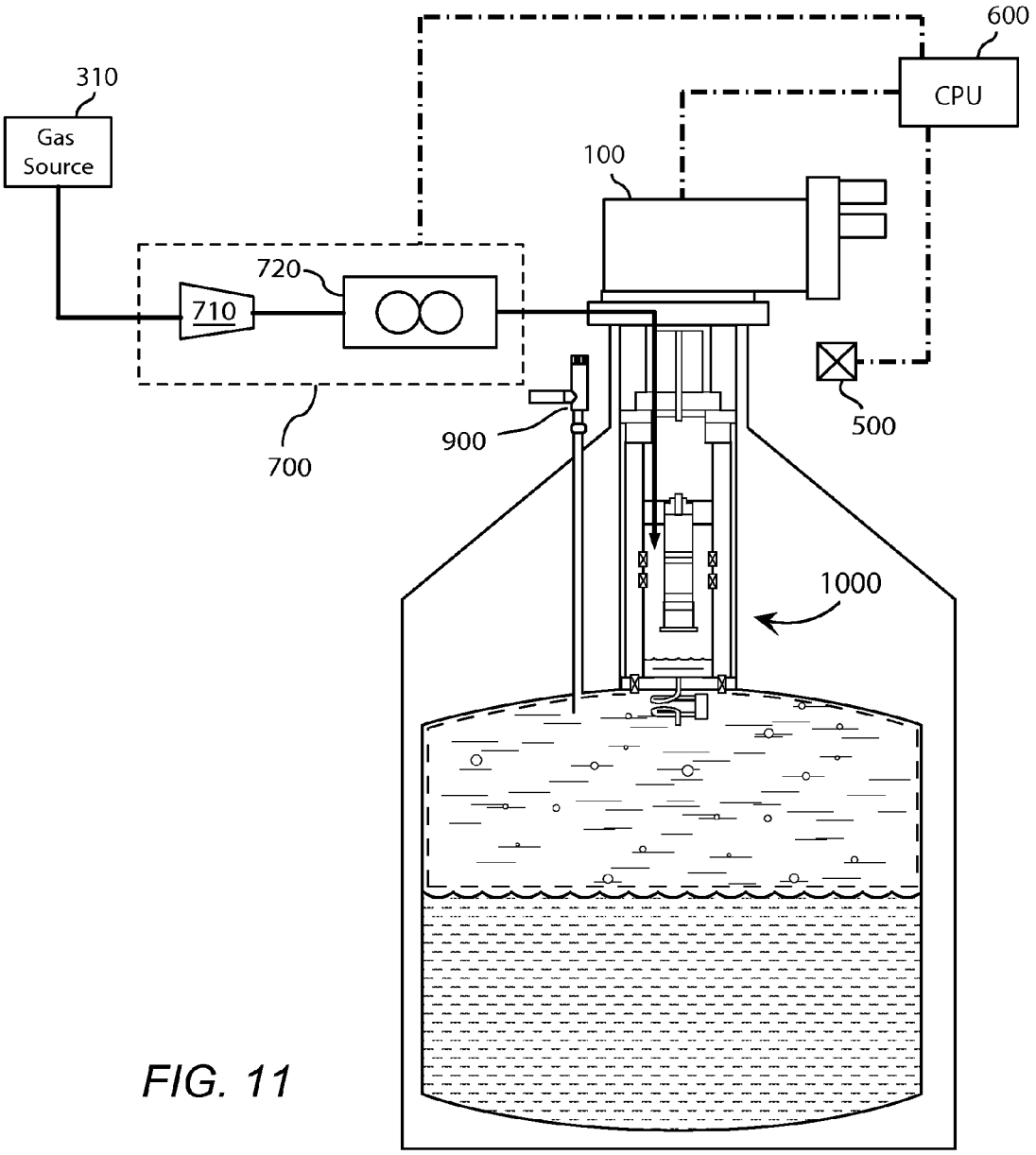
FIG. 11 further illustrates the embodiment of FIGS. 9-10 with control components being lumped into a generic box for simplified illustration.

FIG. 11 further illustrates a liquefier according to an embodiment as illustrated in FIGS. 9-10. The liquefaction chamber embodiment 1000 of FIG. 9 is being illustrated without reference to various internal components for simplicity; however the components may be referenced in more detail as shown in FIG. 9. CPU 600 is coupled to components 500, cryocooler 100, and gas flow control 700. Gas source 310 supplies gas to the gas flow control 700. Gas flow control 700 further comprises a pressure regulator 710 and a mass flow controller 720. A liquid transfer port 900 may be provided for accessing liquefied gas contained within the storage portion and being stored at atmospheric pressure. The liquid transfer port generally comprises an orifice disposed near a top surface of the Dewar and being adapted to expose the storage portion for accessing an amount of liquefied gas therein. In this regard, the isolated liquefaction chamber may perform continuous liquefaction of gas therein at an elevated pressure while providing access to liquid cryogen being stored at atmospheric pressure within the storage portion of the Dewar. Thus, the system is not required to shut down for accessing liquid cryogen.

Accordingly, a liquefier adapted for improved liquefaction efficiency comprises a sealed liquefaction chamber and a storage portion. The sealed liquefaction chamber is adapted for liquefaction at elevated pressures, and particularly adapted for liquefaction near the critical pressure for a selected cryogen gas. The pressure within the liquefaction region is regulated by one or more of: (1) the pressure and/or amount of input gas directed into the liquefaction region using the gas flow control; (2) the amount of gas vented out of the liquefaction region through exhaust valves; or (3) the amount of liquid transferred from the fluid collection reservoir to the storage portion of the Dewar.

Moreover, the sealed liquefaction chamber may be surrounded by a heat exchange region for providing a counter-flow heat exchange for secondary cooling of the liquefaction sleeve and gas contained within the liquefaction region.

In another aspect of the invention, certain methods are disclosed for improved liquefaction efficiency. In one embodiment, a method for providing efficient liquefaction of gas within a liquefier comprises: providing a liquefier having a sealed liquefaction chamber and a storage portion; regulating pressure within the liquefaction chamber near a critical liquefaction pressure for a selected gas; collecting an amount of liquefied gas in a fluid collection reservoir within the chamber; and transferring said liquefied gas to said storage portion of said liquefier through a conduit extending therebetween.

The method may further comprise: providing a heat exchange region surrounding the sealed liquefaction chamber, the heat exchange region being further sealed from the storage portion except for one or more heat exchange valves connecting therebetween; and regulating a flow of gas about the heat exchange region using the one or more heat exchange valves for secondary cooling of said liquefaction region.

Other variations would be recognized by those having skill in the art for providing a liquefaction system with a pressurized well for extracting maximum liquefaction efficiency, and a region for heat exchange to enhance liquefaction performance.

The invention claimed is:

1. A liquefier comprising:

a Dewar having a storage portion for and a neck extending therefrom, the storage portion storing an amount of liquefied gas;

a cryocooler;

a liquefaction chamber at least partially disposed within the neck of the Dewar, the liquefaction chamber further comprising:

a tubular portion extending along a portion of the neck from a first end to a second end and having a volume within the tubular portion between said first and second ends defining a liquefaction region, said cryocooler being positioned adjacent to the first end of the tubular portion and comprising at least one cooling stage extending within the liquefaction region; and a fluid collection reservoir disposed at said second end of the tubular portion and adapted to collect an amount of liquefied gas;

said liquefaction region being adapted to maintain a fluid pressure greater than 1.0 bar for liquefaction of gas;

a heat exchange region collectively defined by the neck and the liquefaction chamber, the heat exchange region structured to provide counter-flow heat exchange by receiving exhaust gas exhausted from the storage portion to cool the liquefaction chamber;

a plate separating the liquefaction region and the heat exchange region from the storage portion;

a conduit disposed within the plate for selectively placing the fluid collection reservoir into fluid communication with the storage portion;

at least one heat exchange valve disposed within the plate, and coupled to a CPU for selectively circulating the exhaust gas from the storage portion to the heat exchange region;

a gas inlet in fluid communication with the liquefaction chamber; and a liquid transfer port in fluid communication with the storage portion of the Dewar for accessing liquefied gas stored within the storage portion.

2. The liquefier of claim 1, further comprising a restriction element coupled to said conduit, the restriction element being adapted to regulate a flow of liquefied gas between the fluid collection reservoir and the storage portion.

3. The liquefier of claim 1, comprising one or more pressure sensors disposed within said liquefaction region.

4. The liquefier of claim 3, further comprising one or more thermometers disposed within said liquefaction region.

5. The liquefier of claim 4, wherein the CPU is coupled to the one or more pressure sensors and to the one or more thermometers, the CPU being adapted to control liquefaction conditions within the liquefaction region of the liquefier, wherein said liquefaction conditions include liquefaction pressure and temperature.

6. The liquefier of claim 5, said liquefaction chamber further comprising one or more exhaust valves for adjusting pressure within the liquefaction region, the exhaust valves being coupled to the CPU for regulation of pressure within the liquefaction region.

7. The liquefier of claim 6, wherein said one or more exhaust valves are operatively coupled to the liquefaction chamber so as to adjust pressure within the liquefaction region by the selective release of gas therefrom into the heat exchange region.

8. The liquefier of claim 6, wherein the heat exchange region at least partially circumnavigates the liquefaction region, and the heat exchange valve is coupled to said CPU for the control thereof.

9. The liquefier of claim 8, wherein at least two heat exchange valves are disposed within the plate and coupled to said CPU for control thereof.

10. The liquefier of claim 1, wherein said storage portion is adapted to store said liquefied gas at atmospheric pressure.

11. The liquefier of claim 1, said liquefaction chamber being adapted to maintain a fluid pressure within said liquefaction region above 1.0 bar and no greater than 2.2 bar.

12. A liquefier comprising:

a Dewar having a storage portion, a neck portion protruding from the storage portion, a liquefaction chamber, and a heat exchange region collectively defined by the neck portion and the liquefaction chamber, the liquefaction chamber and the heat exchange region being sealed from the storage portion, the heat exchange region being structured to provide counter-flow heat exchange by receiving exhaust gas exhausted from the storage portion to cool the liquefaction chamber;

a cryocooler at least partially disposed in the liquefaction chamber;

a conduit disposed within the Dewar for selectively placing the liquefaction chamber into fluid communication with the storage portion;

at least one heat exchange valve disposed within the Dewar, the at least one heat exchange valve coupled to the CPU for selectively circulating the exhaust gas from the storage portion to the heat exchange region;

a gas inlet in fluid communication with the liquefaction chamber;

a liquid transfer port in fluid communication with the storage portion of the Dewar for accessing liquefied gas stored within the storage portion; and a plate separating the liquefaction chamber from the storage portion, the plate having the at least one heat exchange valve positioned outward of the liquefaction chamber, wherein the at least one heat exchange valve is disposed within the plate, wherein the liquefaction chamber is adapted for liquefaction of gas.

13. The liquefier of claim 12, said liquefaction chamber comprising one or more exhaust valves for releasing an amount of gas and reducing pressure therein.

14. The liquefier of claim 12, wherein the CPU connected to one or more control components and a gas flow control for monitoring and controlling liquefaction pressure within the liquefaction chamber.

15. The liquefier of claim 14, wherein said gas flow control comprises a pressure regulator and a mass flow controller.

16. The liquefier of claim 1, wherein the liquefaction region is adapted to maintain a pressure of greater than 80% of a pressure associated with the critical point of the gas being liquefied.

17. The liquefier of claim 8, wherein the one or more heat exchange valves are positioned radially outward of the liquefaction region.

18. The liquefier of claim 1, wherein the storage portion is adapted to maintain a fluid pressure less than the fluid pressure in the liquefaction region.

* * * * *